US005226368A

United States Patent [19]

Brochand et al.

[11] Patent Number: 5,226,368

[45] Date of Patent: Jul. 13, 1993

[54] SAFETY DEVICE FOR AN OVERHEAD CABLE TRANSPORT INSTALLATION TO ENSURE PROPER GRIP OF CABLE UPON COUPLING

[75] Inventors: Max Brochand, Noyarey; Jean-Pierre Rastello, Fontaine, both of France

[73] Assignee: Pomagalski, France

[21] Appl. No.: 889,403

[22] Filed: May 28, 1992

[30] Foreign Application Priority Data

Jun. 3, 1991 [FR] France ..... 91 06775

[51] Int. Cl.[5] ..... B61B 12/06

[52] U.S. Cl. ..... 104/179; 104/173.2

[58] Field of Search ..... 104/87, 173.2, 178, 104/179, 180

[56] References Cited

U.S. PATENT DOCUMENTS 4,210,019 7/1980 Laurent ..... 104/179
4,699,064 10/1987 Tarassoff ..... 104/173.2 X

FOREIGN PATENT DOCUMENTS 255490 2/1988 European Pat. Off. ..... 104/179
287068 10/1988 European Pat. Off. ..... 104/173.2
2355294 5/1974 Fed. Rep. of Germany ..... 104/179
259291 1/1949 Switzerland .
8501257 3/1985 World Int. Prop. O. ..... 104/179

*Primary Examiner*—Robert J. Oberleitner
*Assistant Examiner*—S. Joseph Morano
*Attorney, Agent, or Firm*—Parkhurst, Wendel & Rossi

[57] ABSTRACT

An overhead cable transport installation (e.g., a gondola lift or a chairlift) possesses a transfer rail in an end station on which grips of carriages are detached from the cable. At the exit of this transfer rail a coupling rail section extends parallel to the cable so that the cable is inserted between the jaws of the grip before the closing of the grip for clamping the cable. The coupling rail section comprises a safety device in the form of a sleeve partially surrounding the cable which allows the free passage of the grip when the cable is inserted between the jaws. Conversely, when the cable is outside the jaws, the grip is wedged and held back to prevent the chair from reaching the end of the transfer rail and falling down.

5 Claims, 4 Drawing Sheets

SAFETY DEVICE FOR AN OVERHEAD CABLE TRANSPORT INSTALLATION TO ENSURE PROPER GRIP OF CABLE UPON COUPLING

BACKGROUND OF THE INVENTION

The invention relates to an overhead cable transport installation, in particular a gondola lift or a chairlift, comprising a closed-loop overhead haulage-track cable extending between two end stations and running in a closed circuit. A plurality of carriages each supporting a gondola or a chair and having a detachable grip are able to be coupled to the cable for travel along the circuit, detached from the cable upon entering a station, and recoupled to the cable upon leaving the station. Each grip has a pair of jaws for clamping the cable. In the station, the detached carriages run on a transfer rail before being recoupled on the cable. A coupling rail section at the exit of the transfer rail, extends substantially parallel to the cable so that the cable is inserted between the pair of jaws. The coupling rail section is equipped with a grip actuating device for closing the jaws and coupling the carriage to the cable before the carriage leaves the coupling rail section.

The U.S. Pat. No. 4,699,064 describes an installation of the above-described type. In such known installations an assortment of safety sensors are generally mounted on or about various mechanical and electrical devices so as to report on various operating conditions and to cause the stopping of the installation if necessary. Sensing switches are for instance placed adjacent the grip run in the station to determine the position of the grip, and to stop the installation when the jaws are not closed at the exit of the coupling rail section. The power supply to the electrical motor of the installation is interrupted but the stopping is not immediate and the carriage further moves a given distance. If the grip is open or does not bear on the cable, the carriage falls down at the end of the transfer rail.

The object of the present invention is to improve operational safety of an installation and to prevent the falling down of a gondola or of a chair.

SUMMARY OF THE INVENTION

The coupling rail section of the invention comprises a safety device constituted by a fixed passageway which surrounds the travel path of the grip and of the cable, and the internal shape of this passageway corresponds to the dimensions of the grip, more particularly, to the dimensions of the jaws which clamp the cable. When the grip correctly clamps the cable it passes freely through the passageway and at the end of the transfer rail is supported by the cable. Conversely, when the cable remains outside the pair of jaws, their overall dimensions exceeds that of the passageway and the grip is jammed and immediately stopped by the safety device. Of course, the jamming is detected by means of usual sensors which interrupt the power supply to the motor.

The sudden stopping of the gondola or chair provokes a dangerous swinging. Accordingly, another object of the invention is to provide a friction-based, motion damping assembly to prevent such swinging.

To reach this objective, the safety device according to the present invention is slidably mounted and can be moved in the cable direction along a restricted distance by the jammed grip. Friction members brake this motion for damping the swinging of the gondola or chair.

The safety device may be in the form of a fixed slotted sleeve which includes a lower part extending under the cable to catch the cable in case of derailment.

BRIEF DESCRIPTION OF THE DRAWINGS

Other advantages and features will become more clearly apparent from the following description of an illustrative embodiment of the invention, given as a non restrictive example only and represented in the accompanying drawings, in which.

DESCRIPTION OF THE PREFERRED EMBODIMENT

Figure 1:
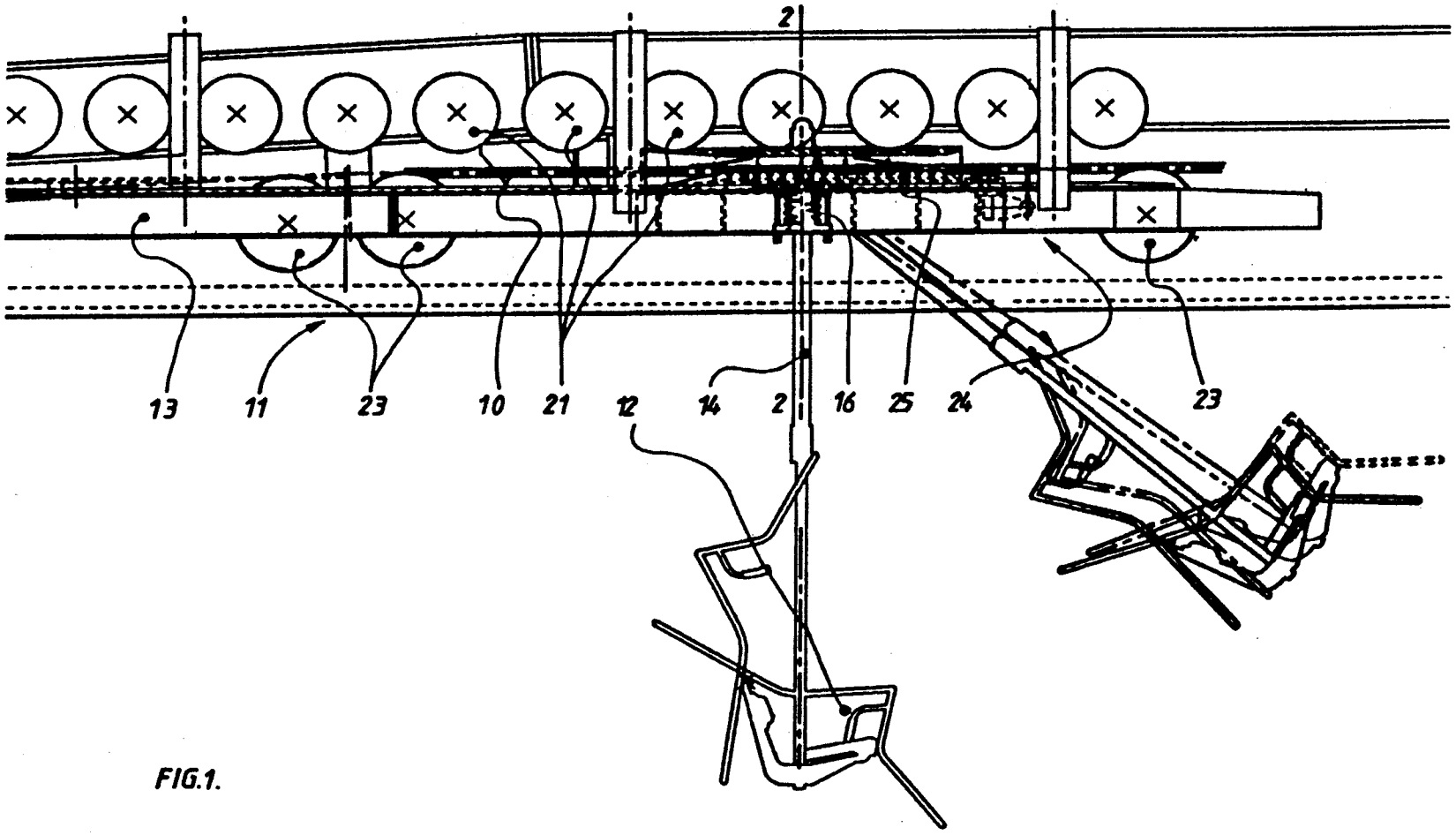
FIG. 1 is a schematic elevational view of a coupling section equipped with a safety device of an installation according to the invention.

In the drawings, an overhead cable transport installation (e.g., a single cable detachable gondola lift or chair lift) comprises a hauling-carrier cable 10, extending in a closed loop between two uphill and downhill stations running on return end wheels and along an up track and a down track. The cable 10 is supported by sheaves mounted on towers. The loads, particularly cabins or chairs 12, hereafter named chairs, are each fixed by a hanger arm 14 to a carriage having a grip 16 coupling it to the cable 10. The grip 16 includes a pair of jaws 17 and the upper end 15 of the hanger arm is pivotally mounted on the grip body. A spring 20 urges the jaws 17 into the cable clamping position, opening being controlled by a lever 19 cooperating with a fixed ramp. The grip 16 has rollers 18 and a drive plate 22 cooperating with friction drive sheaves 21.

At the entry to the station, a half loop transfer rail 13 on which the rollers 18 engage, is disposed parallel to the cable 10 and a ramp opens the grip 16 to uncouple the chair 12 from the cable 10. The friction drive sheaves 21 cooperate with the plate 22 of the grip 16 to drive the latter. The sheaves 21 decelerate the chair 12 detached from the cable 10, drive the grip 16 on the rail 13 at low speed and accelerate it along a coupling rail section 11 for coupling to the cable 10 at the station exit. The coupling rail section 11 is fitted with sheaves 23 which support and guide the cable 10 so as to run parallel to the rail 13 with a slight slope upwards to insert progressively the cable 10 between the pair of jaws 17 during the travel of the grip 16 on the coupling rail section 11. At the exit 24 of coupling rail section 11, the control lever 19 closes the pair of jaws 17 for clamping the cable 10 before the grip 16 leaves the transfer rail 13. The coupling rail section 11 comprises well known safety devices (not shown) which control for instance the geometrical position of the cable, the uncoupling or the coupling of the grip and the travel of the grip.

According to the present invention the coupling rail section 11 is fitted with a safety device 25, located at the cable insert area before the exit 24, so that the grip 16 bearing on through cable passes the safety device 25 before leaving the coupling rail section 11. The safety device forms a slotted sleeve 26 surrounding a short cable section. The safety device 25 is slidably mounted on slides 27 extending parallel to the rail 13 in such a manner that the safety device can be moved a short distance towards the exit 24. The slides 27 are rigidly secured to the rail 13 or to the frame of the station. Braking blocks 28 cooperate with the slides 27 or another part of the safety device 25 so as to brake the sliding motion of the safety device. The inner outline 29 of the sleeve 26 is adapted to the shape of the jaws 17 so as to allow the free passage of these jaws 17 when the cable 10 is inserted between the jaws 17, and to wedge the jaws when they are located adjacent to the cable 10. The sleeve 26 entry is enlarged to provoke a progressive jamming and the lower part 30 of the sleeve extends horizontally or slightly concave under the cable for catching it in case of derailment of the cable 10 or falling down of a support sheave 23.

Figure 2:
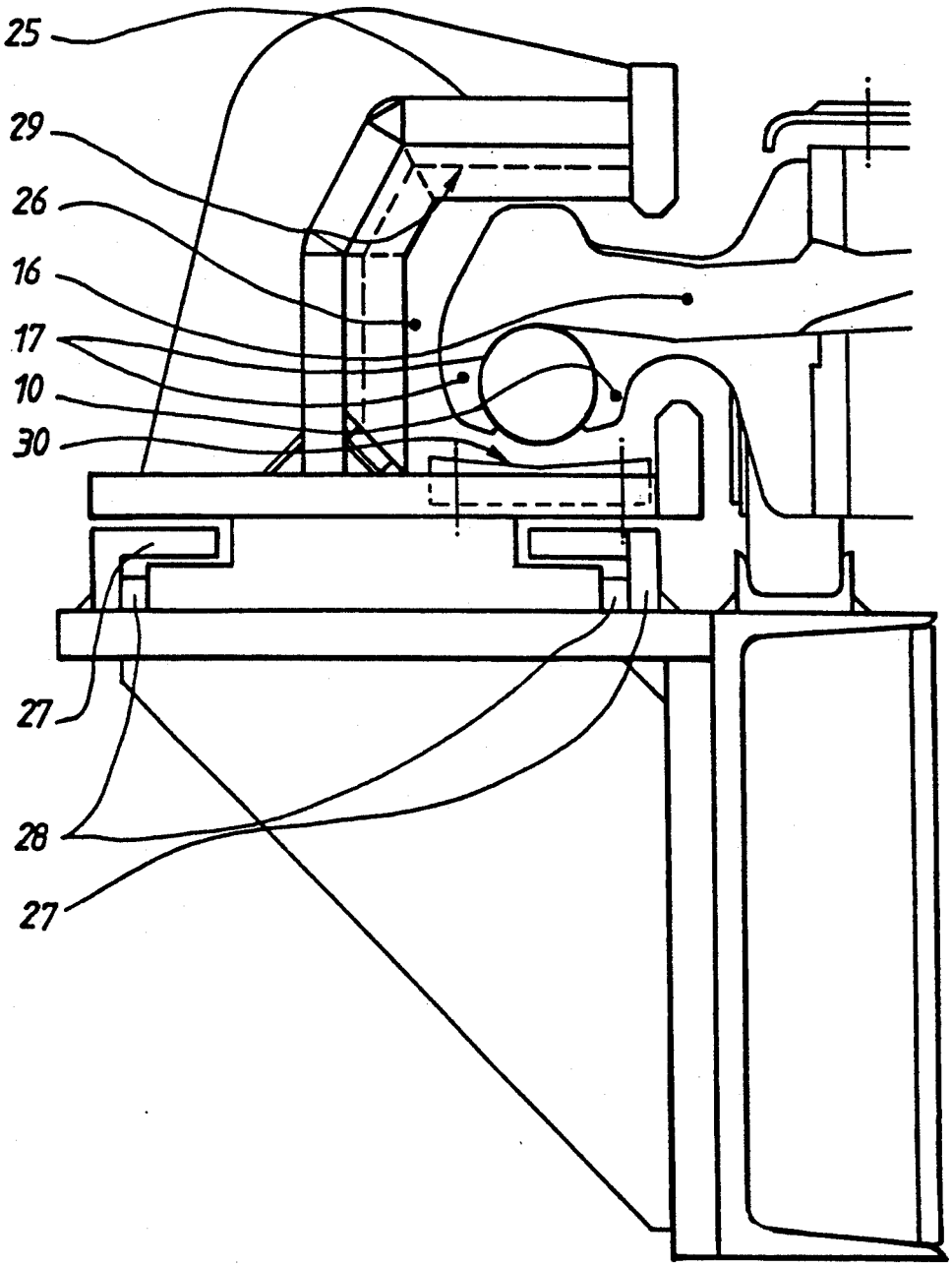
FIG. 2 is a cross-section along the line 2—2 of FIG. 1, showing the grip passage through the gauge.
Figure 3:
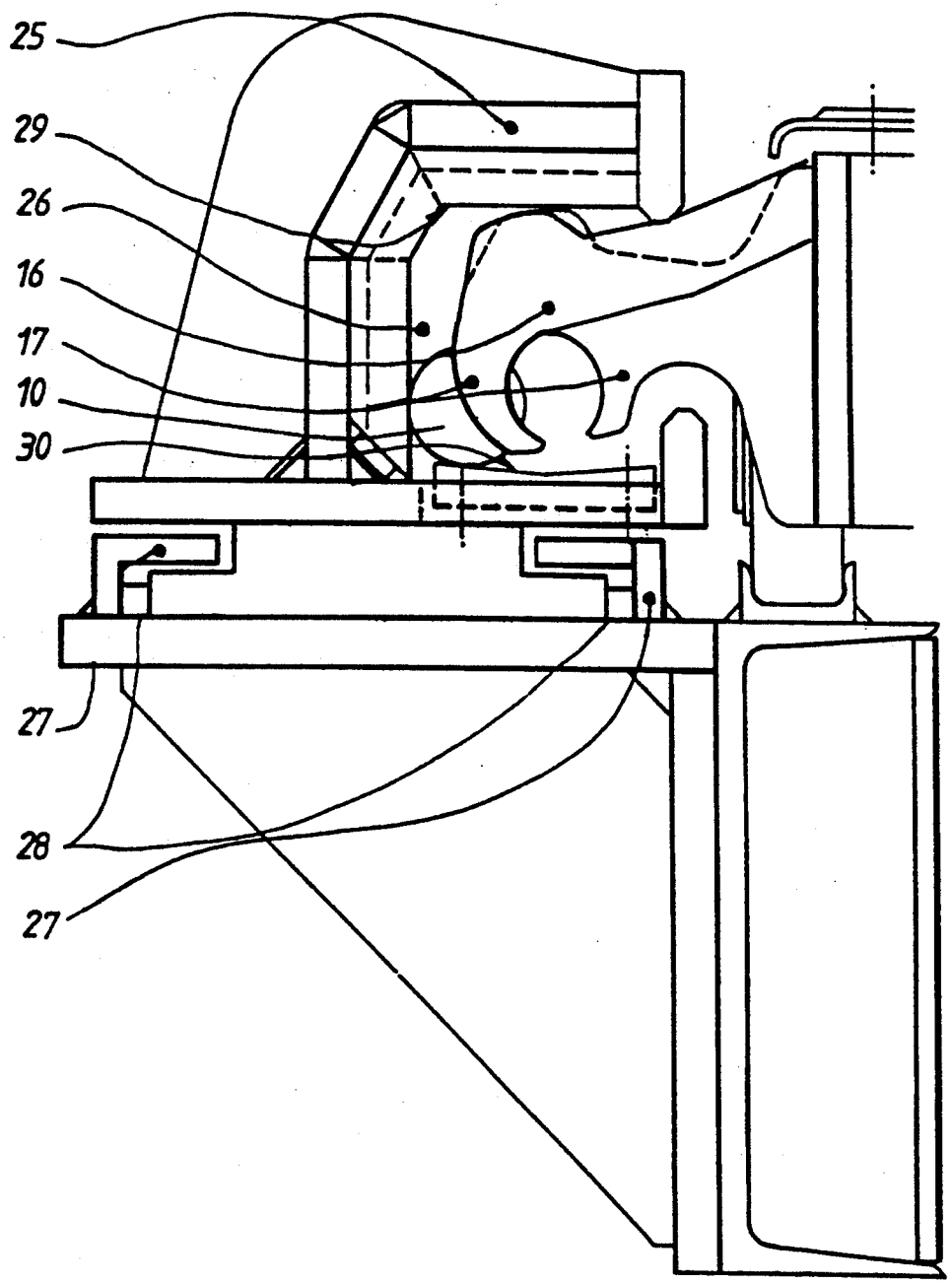
FIG. 3 is a similar view to that of FIG. 2 illustrating the grip jamming.
Figure 4:
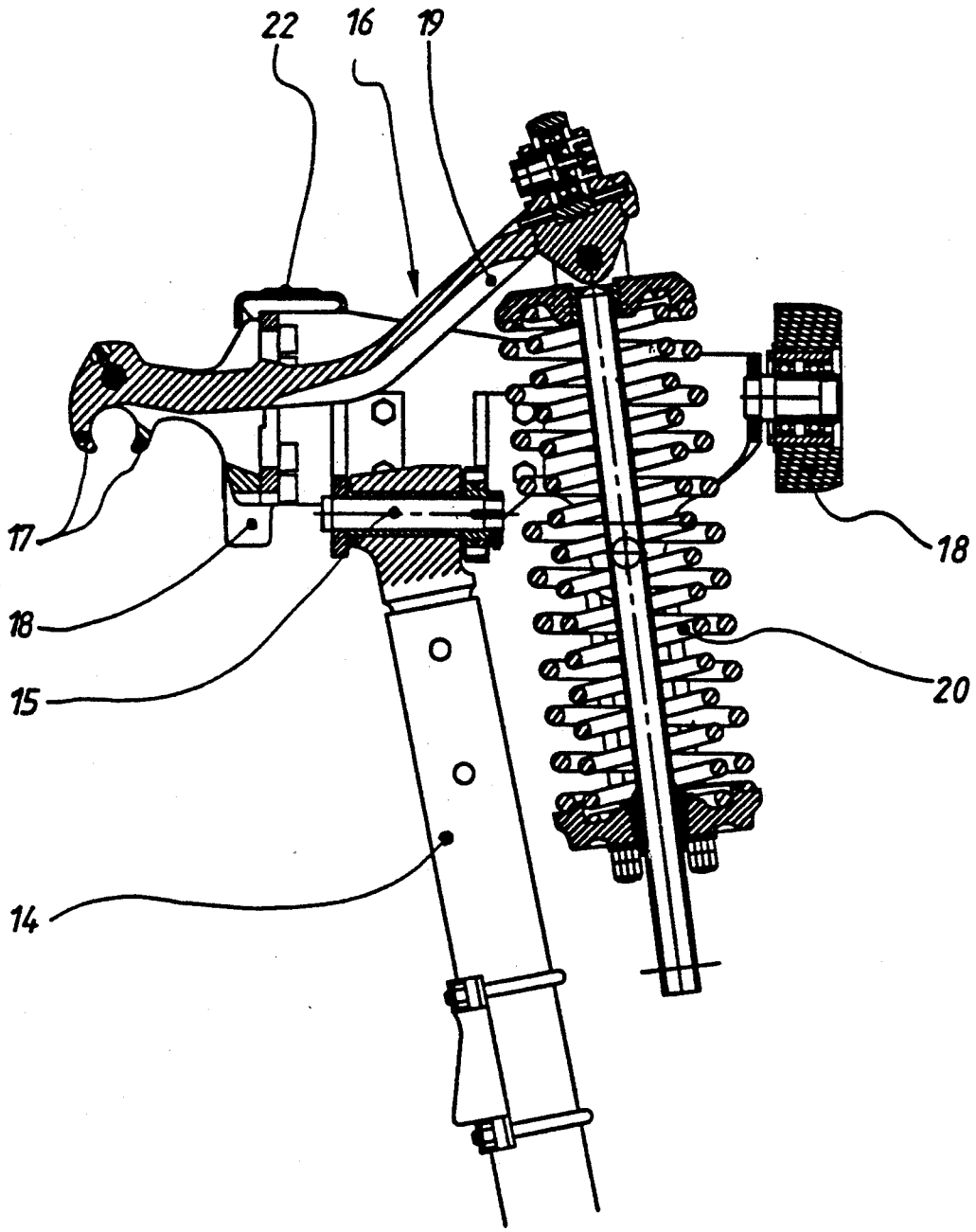
FIG. 4 is a side view which shows the grip at the coupling rail section exit.

Turning to FIG. 2, it will be apparent that during normal travel of the grip 16 through the safety device 25 of the coupling rail section 11, the passage of the grip is not hindered by the safety device 25, as the space between the safety device 25 and the jaws 17 prevents any contact. Conversely, as depicted in FIG. 3 when the cable 10 is not inserted between the jaws 17 and is disposed adjacent to these jaws 17, the grip 16 is wedged in the sleeve 26 and held back. The forward swinging of the chair 12 due to the stopping of the grip 16 is damped by the sliding of the sleeve 26 in the slides 27, whereby sleeve 26 is frictionally braked by the braking blocks 28. It will be understood that at the end of the slides 27 the sleeve 26 and the jammed grip 16 are mechanically stopped and that the chair 12 cannot reach the end of the transfer rail 13. A detector for detecting the sliding the sleeve 26 or of the stopping or swinging of the chair interrupts the motor power supply. The cable 10 which has been further moved through the stopped sleeve 26 is now stopped. Thereafter the installation should be checked.

What is claimed is:

1. An overhead cable transport installation, comprising:

an overhead closed-loop haulage-track cable extending between first and second end stations;

a plurality of carriages each supporting a load and having a detachable grip for detaching each carriage from said cable upon entering said first end station and for coupling each carriage to the cable upon leaving said first end station, each grip comprising a pair of jaws for clamping the cable;

a transfer rail in said first end station on which the carriages run before being coupled to the cable, said transfer rail comprising a coupling rail section extending substantially parallel to said cable so that the cable is inserted between said pair of jaws, said coupling rail section comprising a grip actuating device for closing said jaws to couple the carriage to the cable before the carriage leaves the coupling rail section; and a safety device located on said coupling rail section, said safety device defining a passageway for passage of said cable and said pair of jaws, said passageway having internal dimensions which allow free passage of the cable and of the pair of jaws when the cable is inserted between said pair of jaws, whereby the pair of jaws are wedged against said safety device thereby stopping movement of said pair of jaws with respect to said safety device when the cable is outside the pair of jaws.

2. The installation of claim 1, wherein said safety device is slidable in the cable direction, said installation comprising braking and stopping means for restricting and limiting sliding movement of said safety device when the pair of jaws and the cable are wedged against the safety device.

3. The installation of claim 1, wherein said safety device comprises a slotted sleeve defining the passageway, said sleeve having an enlarged entrance and partially surrounding the cable.

4. The installation of claim 3, wherein said sleeve comprises slides extending along the cable direction and damping means which frictionally engage the sleeve for motion damping of said safety device.

5. The installation of claim 1, wherein said safety device comprises a lower part defining a bottom surface extending under the cable.

* * * * *